US009259374B2

(12) United States Patent
Castellote et al.

(10) Patent No.: US 9,259,374 B2
(45) Date of Patent: Feb. 16, 2016

(54) WATER MASSAGE SYSTEM FOR TUBS

(71) Applicant: C.G. AIR SYSTÈMES INC., Ste-Marguerite-de-Dorchester (CA)

(72) Inventors: Miguel Castellote, Sainte-Marguerite-de-Dorchester (CA); Dominique Ciechanowski, Sainte-Marguerite-de-Dorchester (CA)

(73) Assignee: C.G. AIR SYSTÈMES INC., Sainte-Marguerite-de-Dorchester, Quebec (CA)

( * ) Notice: Subject to any disclaimer, the term of this patent is extended or adjusted under 35 U.S.C. 154(b) by 345 days.

(21) Appl. No.: 13/869,414

(22) Filed: Apr. 24, 2013

(65) Prior Publication Data

US 2013/0276222 A1 Oct. 24, 2013

Related U.S. Application Data

(60) Provisional application No. 61/637,453, filed on Apr. 24, 2012.

(51) Int. Cl.

| | |
|---|---|
| ***A61H 33/04*** | (2006.01) |
| ***A61H 33/00*** | (2006.01) |
| ***A61H 33/02*** | (2006.01) |

(52) U.S. Cl.

CPC ..... *A61H 33/0087* (2013.01); *A61H 33/02* (2013.01); *A61H 33/601* (2013.01)

(58) Field of Classification Search

CPC ..... A61H 33/027

USPC ..... 4/538–595

See application file for complete search history.

(56) References Cited

U.S. PATENT DOCUMENTS

| | | | | |
|---|---|---|---|---|
| 4,985,943 | A * | 1/1991 | Tobias et al. | 4/541.6 |
| 6,401,273 | B1 * | 6/2002 | Fung et al. | 4/559 |
| 2005/0210575 | A1 * | 9/2005 | Erb | 4/541.1 |

FOREIGN PATENT DOCUMENTS

WO 0243543 A2 6/2002

* cited by examiner

*Primary Examiner* — Lori Baker

(74) *Attorney, Agent, or Firm* — Norton Rose Fulbright Canada LLP

(57) ABSTRACT

An assembly of a tub and liquid massage system, comprises a tub defining a bathing cavity for receiving liquid. A tub wall of the tub has a plurality of openings. A liquid massage system comprises a liquid circuit for collecting liquid from the tub, the liquid having at least a pump device for exposing the liquid in the liquid circuit to a pump action. A plurality of nozzles are provided at ends of the liquid circuit, each nozzle having a nozzle body with at least one connector portion in fluid communication with the liquid circuit. The nozzle body defines an outlet adapted to be mounted to a tub wall opposite one said opening in the tub wall for feeding liquid from the liquid circuit to the outlet into the bathing cavity of the tub, at least some of the nozzles having a throat portion in the outlet, the nozzles with the throat portion having an inner diameter reduction ratio between the nozzle body and the outlet of at least 2.5.

16 Claims, 5 Drawing Sheets

WATER MASSAGE SYSTEM FOR TUBS

CROSS-REFERENCE TO RELATED APPLICATION

The present application claims priority on U.S. Provisional Application No. 61/637,453, filed on Apr. 24, 2012, and incorporated herewith by reference.

FIELD OF THE APPLICATION

The present application relates to jet massage systems used in tubs, such as bathtubs, hot tubs, whirlpools and similar basins, and more particularly to a jet for the injection of water into the liquid of such tubs to procure a massaging effect for the occupant of the tub.

BACKGROUND OF THE ART

Tubs are well known for their primary use, namely a washroom installation in which a user person washes/bathes. Tubs have, however, evolved to add pleasure and comfort to practicality, and are found in many forms, such as bathtubs, spas and whirlpools. For instance, tubs are now provided with water massage systems, as known as whirlpool systems.

Massage systems of various configurations have been provided to inject fluids, such as air or water, into the liquid of the tub, so as to procure a massaging effect for the occupant of the tub. One known water massage system comprises a network featuring a pump that collects water from the tub, and re-injects the water with velocity and/or pressure via nozzles strategically positioned at strategic locations in the wall of the tub. These water massage systems typically have a venturi to add air to the water flow, and hence inject a mixture of air/water in the water of the tub.

Despite creating a strong massaging effect, there remains a need to perform additional effects to provide different types of treatment with water massage systems.

SUMMARY OF THE APPLICATION

It is therefore an aim of the present disclosure to provide a water massage system that addresses issues associated with the prior art.

Therefore, in accordance with the present application, there is provided an assembly of a tub and liquid massage system, comprising: a tub defining a bathing cavity for receiving liquid, a tub wall of the tub having a plurality of openings; a liquid massage system comprising: a liquid circuit for collecting liquid from the tub, the liquid having at least a pump device for exposing the liquid in the liquid circuit to a pump action; and a plurality of nozzles at ends of the liquid circuit, each said nozzle having a nozzle body with at least one connector portion in fluid communication with the liquid circuit, the nozzle body defining an outlet adapted to be mounted to a tub wall opposite one said opening in the tub wall for feeding liquid from the liquid circuit to the outlet into the bathing cavity of the tub, at least some of the nozzles having a throat portion in the outlet, the nozzles with the throat portion having an inner diameter reduction ratio between the nozzle body and the outlet of at least 2.5.

Further in accordance with the present disclosure, there is provided a method for injecting liquid in the liquid of a tub of the type having a plurality of nozzles mounted to a tub wall opposite openings in the tub wall, comprising: collecting liquid from the tub and exposing the liquid to a pump action; directing the fluid to a nozzle body of the nozzle to inject the liquid in the tub via an outlet of the nozzle body; and exposing the liquid to an inner diameter reduction between the nozzle body and the outlet at a ratio of at least 2.5.

DESCRIPTION OF THE PREFERRED EMBODIMENTS

Figure 1:
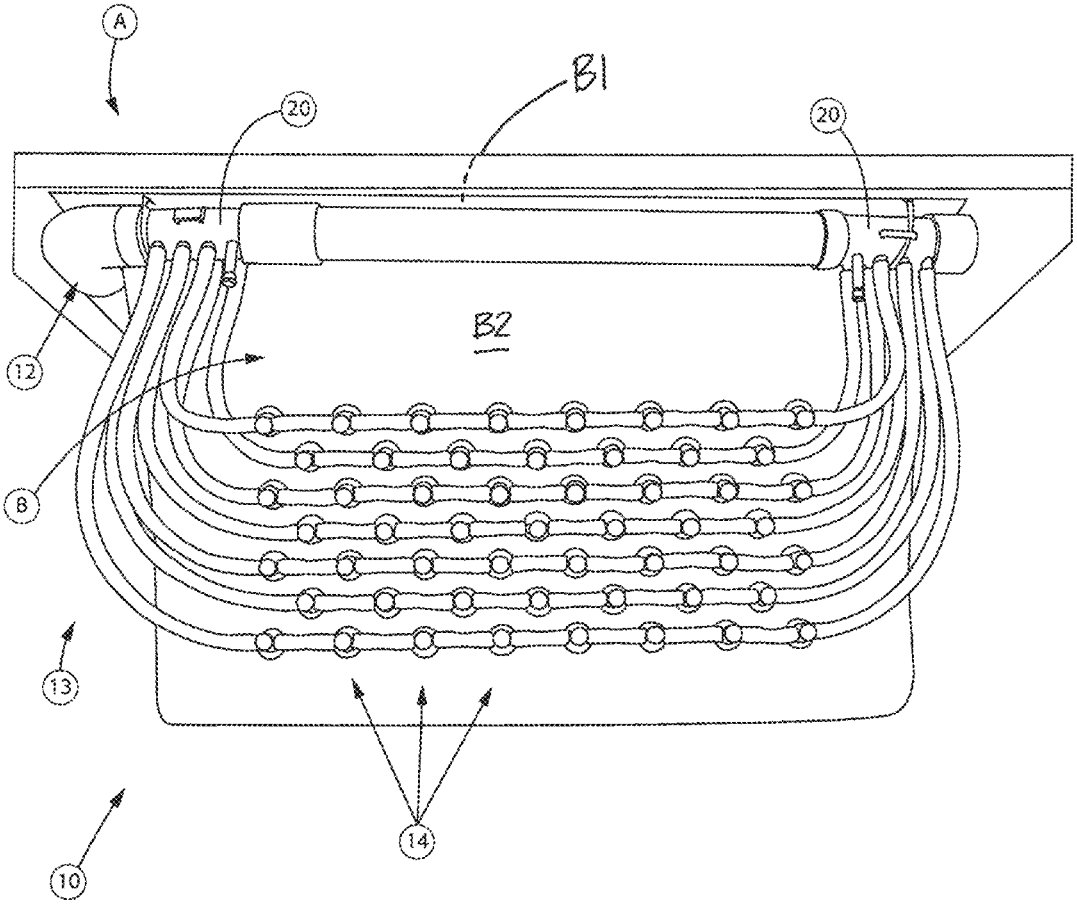
FIG. 1 is an end elevation view of a water massage system in accordance with an embodiment of the present disclosure, as mounted to a hidden surface of a tub.
Figure 2:
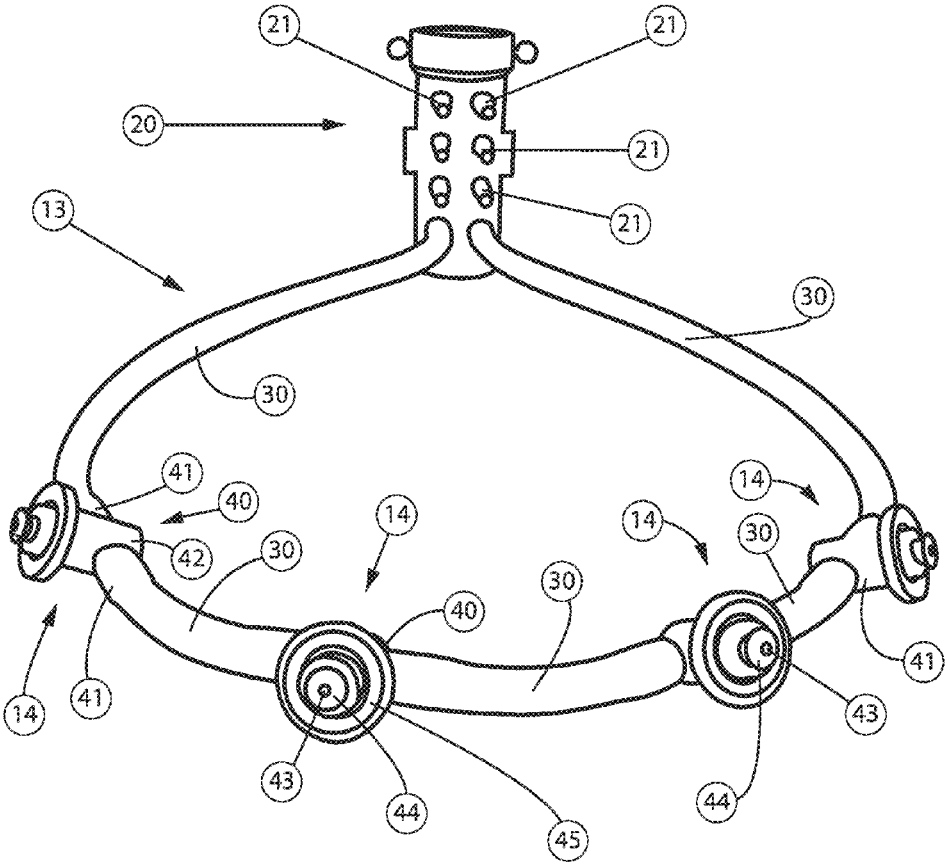
FIG. 2 is a perspective view of a loop of flexible interface pipe with nozzles of the water massage system of FIG. 1.

Referring to the drawings and more particularly to FIGS. 1 and 2, there is shown a water massage system 10 as mounted to a tub A. The tub A is of the type defining a cavity B with its tub wall having an exposed surface B1 and a hidden surface B2, in the case wherein the tub A is a built-in tub. The tub A may be any of a bathtub, a spa, a whirlpool, a Jacuzzi, etc. Most of the water massage system 10 is located on the underside of the tub A, opposite the hidden surface B2. Therefore, a majority of the components of the massage system 10 are mounted adjacent to the hidden surface of the tub A and are thus not visible to an observer/user of the tub A as many of these components are built-in under the tub. As will be described hereinafter, some components of the water massage system 10 are visible to an observer/user of the tub. In some instances, the system 10 may be exposed.

Figure 5:
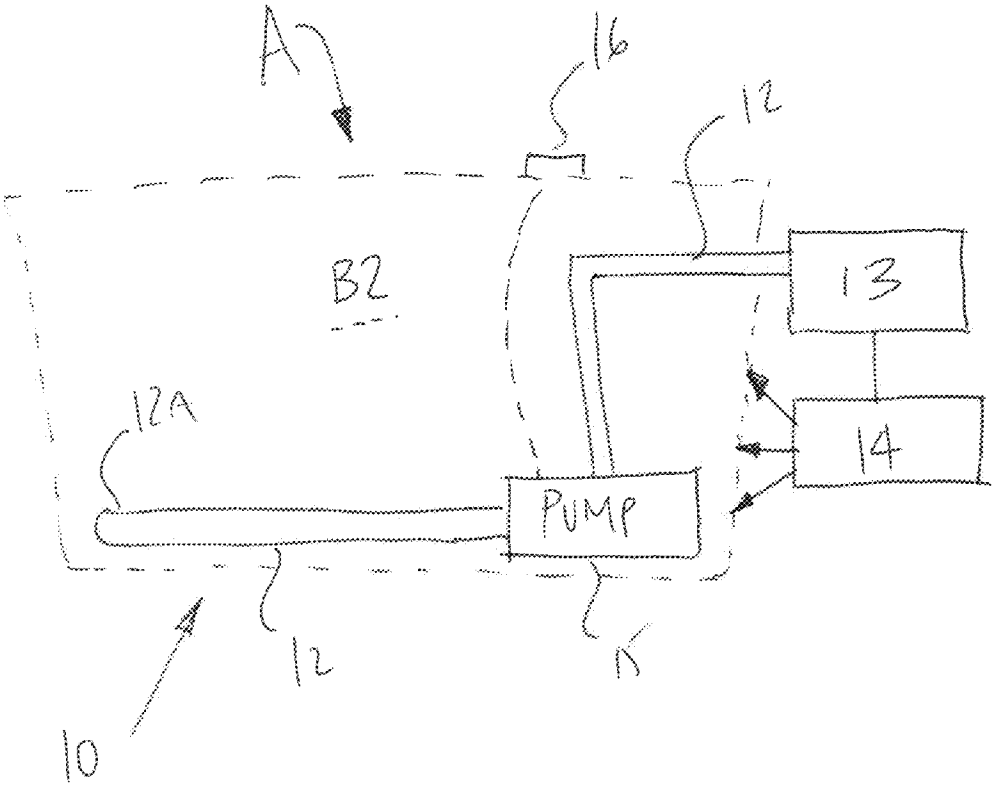
FIG. 5 is a schematic view of the water massage system relative to the tub.

Referring to FIG. 5, the water massage system 10 comprises a feed pipe 12, flexible interface pipes 13 and nozzles 14. The feed pipe 12 has an inlet end 12A connected to the lower portion of the tub A to collect liquid therefrom. The feed pipe 12 also comprises at least one pump 15 downstream of the inlet end 12A to increase a pressure and/or velocity of the fluid in the feed pipe 12. A user interface 16 is exposed on the exterior of the tub A or in its surroundings, and may be of any type, such as on/off switch, keypad, touchpad, etc. All necessary precautions must be taken during installation to prevent electrical hazards.

The flexible interface pipes 13 connect the feed pipe 12 to the nozzles 14. The nozzles 14 are the liquid outlets of the water massage system 10, and therefore re-inject the liquid back into the liquid of the tub A, with the liquid being injected with some increased velocity to procure a massaging effect to the occupant of the tub A.

Still referring to FIG. 1, the feed pipe 12 is shown as having a plurality of manifold segments 20. The manifold segments 20 are interconnected end to end, and each of the manifold segments 20 comprises a plurality of outlet ports 21. The manifold segments 20 are positioned downstream of the pump in the feed pipe 12, and typically each consists of a polymeric material, such as ABS, although other polymers and metals may be used as alternatives. In an embodiment, the material of the manifold segments 20 is the same as that of other pipe portions of the feed pipe 12, to facilitate the interconnection between the various components of the feed pipe 12.

In FIG. 2, there is illustrated one such manifold segment 20 with eight different outlet ports 21. The manifold segment 20 may have more or less of the outlet ports 21. The outlet ports 21 may be equipped with hose barb for sealingly connecting ends of the flexible interface pipes 13 to the outlet ports 21. Other configurations are possible, for instance with the use of a warm gear hose clamp, etc.

Referring concurrently to FIGS. 1 and 2, the flexible interface pipes 13 are shown consisting of a plurality of flexible pipe segments 30. The flexible pipe segments 30 are interconnected by the nozzles 14. It is observed that each flexible interface pipe 13 may form a loop in that opposed ends of the flexible interface pipes 13 are both connected to outlet ports 21 of the same manifold segment 20 as in FIG. 2, or of different manifold segments 20 as in FIG. 1. The loop configuration of the flexible interface pipes 13 ensures that each of the nozzles 14 is provided with a generally equal flow of liquid to be injected in the tub A. It is however contemplated to arrange the pipes 13 as branches with an end 13 connected to the manifold segment 20, and an opposite end connected to a nozzle 14 (with elbow fitting or tee fitting), with other nozzles in the branch (e.g., with tee fittings).

Figure 3:
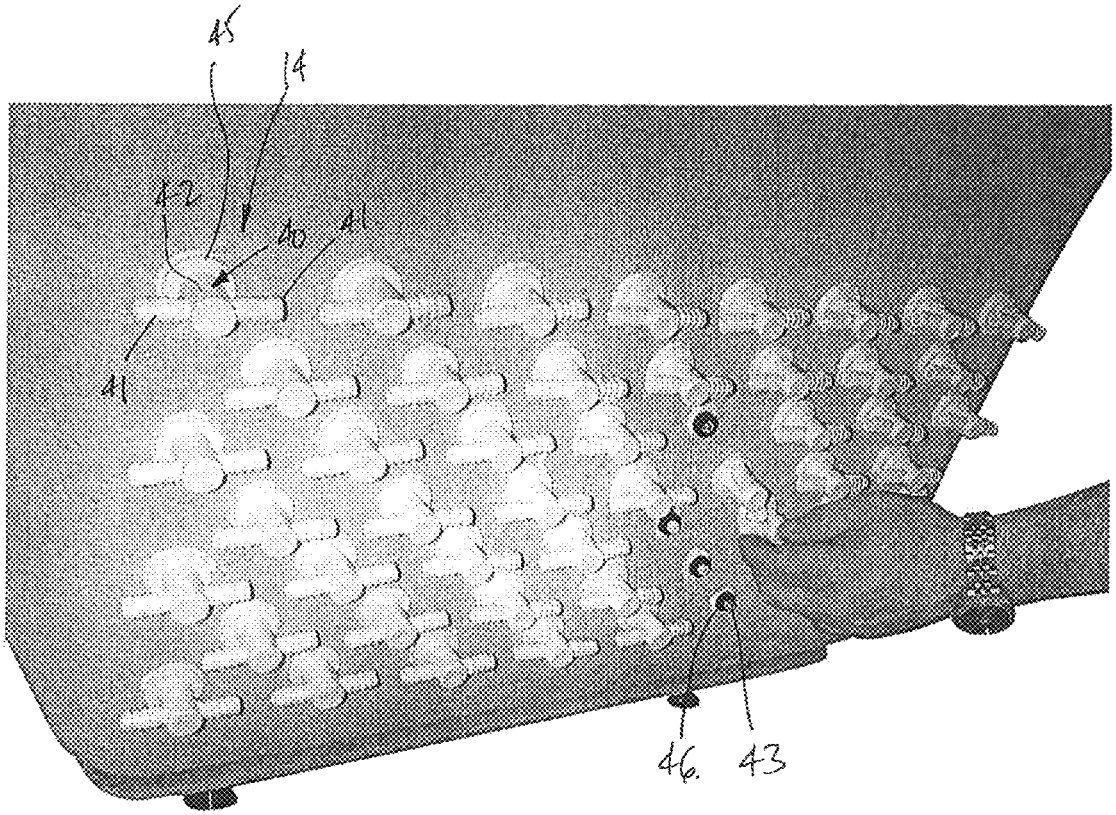
FIG. 3 is a perspective view of nozzles of the water massage system of the present disclosure as mounted to a tub wall.

Referring concurrently to FIGS. 2 and 3, the nozzles 14 are each shown comprising a nozzle body 40 (e.g., a tee fitting) consisting of a pair of co-axial opposed connector portions 41, and a tubular outlet portion 42 generally perpendicular to the connector portions 41. The connector portions 41 may have any appropriate configuration to be connected to the pipe segments 30. For instance, FIG. 3 illustrates the connector portions 41 as featuring hose barb. Other configurations are possible, including the use of hose clamps, an elbow or nipple fitting for the nozzle 14, etc.

Figure 4:
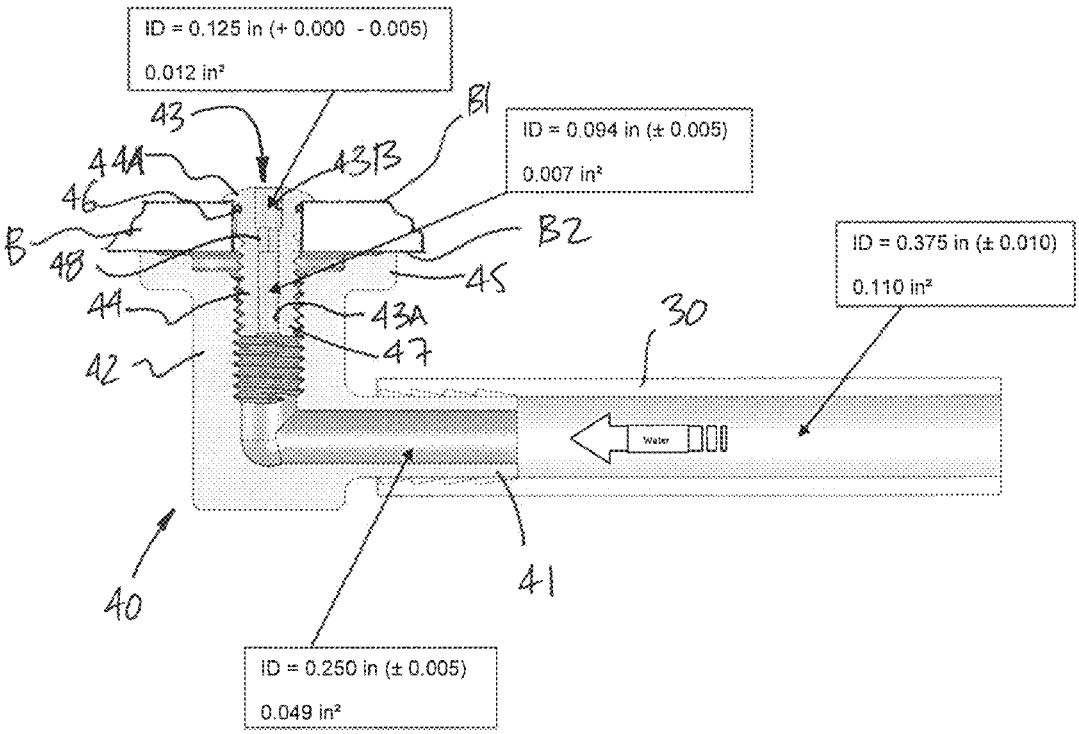
FIG. 4 is a sectional view of a flexible pipe interface and nozzle relative to the tub.

Referring to FIG. 4, one of the nozzles 14 is shown in greater detail. The nozzle body 40 is an elbow fitting, although other types of fittings could be used, as described above. The nozzle body 40 is hollow, such that liquid fed from the flexible pipe segments 30 enters the nozzle 14 via the connector portion 41, and is then directed into the tubular outlet portion 42. The liquid then exits the nozzle 14 via the outlet 43. The outlet 43 is the conduit of the nozzle 14 through which the fluid exits. In the illustrated embodiment, the outlet 43 is bound by the inner circumference of the tubular outlet portion 42, and by a tubular head insert 44 of the nozzle 14, received in the tubular outlet portion 42. The head insert 44 is one of the few visible parts of the water massage systems 10, along with the inlet 12A of the feed pipe 12 (FIG. 5), and the user interface 16. The head insert 44 has a flange 44A at its downstream end. It also considered to completely hide the nozzle 14 behind the tub wall. As shown in FIGS. 2, 3 and 4, the nozzles 14 may each have a flange 45 that is part of the nozzle body 40, to be secured with an adhesive to the hidden surface B2 at the tub A. Moreover, any appropriate sealing device, such as seal 46 may be provided between the tubular outlet portion 42 and the nozzle head insert 44 to prevent any water leak thereat. Any other sealing configuration is considered as well. Hence, as shown in FIG. 4, the nozzle 14 may be secured to a tub wall by being sandwiched between the flanges 44A and 45. As shown in FIGS. 3 and 4, a portion 47 of the head insert 44 may have threading so as to be threadingly engaged to tapping inside the tubular outlet portion 42 of the nozzle body 40. In the illustrated embodiment, an appropriate hexagonal socket 48 is provided in the channel of the head insert 44 to tighten the head insert 44 to the nozzle body 40, and squeeze the seal 46 against the wall of the tub. Any other appropriate engagement means is considered as well (e.g., snap-fitting, etc). In FIG. 3, the seal 46 is of the type that is against the flange 45 and against the hidden surface B2 of the tub A (and in an appropriate annular groove of the flange 45), while the seal 46 in FIG. 3 is an O-ring abutting against the exposed surface B1 of the tub A. Either or both of these configurations could be used in the water massage system 10.

It is observed that the head insert 44 defines a throat portion 43A in the outlet 43, representing the smallest diameter of the nozzle 14. In the illustrated embodiment, the downstream-most portion 43B of the outlet 43 is an enlargement relative to the throat portion 43A. In the event that the outlet 43 has the enlarged portion 43B downstream of the throat portion 43A as in FIG. 4, the enlargement may allow the fluid jet to expand to a cone-like shape. It is also considered to end the outlet 43 with the throat portion 43A (without any downstream enlargement). Moreover, although the use of the head insert 44 is a well suited arrangement to define the throat portion 43A and to secure the nozzle 14 to the tub wall by sandwiching same between the flanges 44A and 45, it is considered to provide the nozzle 14 with other constructions. For instance, the tubular outlet portion 42 may be machined or molded to define an outlet channel 43 with the throat portion 43A.

The inner diameter of the pipe segments 30 is standard at about 0.375 in ±0.010 in. For an inner diameter of 0.375 in, the cross-sectional area is 0.110 $in^2$. This represents a reduction of inner diameter compared to that of the feed pipe 12 (e.g., 1.50 in±0.25 in).

The inner diameter of the nozzle body 40, i.e., of the connector portion 41 and tubular outlet portion 42 is standard at about 0.250 in±0.005 in. For an inner diameter of 0.250 in, the cross-sectional area is 0.049 $in^2$.

Conventional outlets of water massage systems generally have the same inner diameter as that of the nozzle body, or are slightly smaller. In other words, conventional outlets would have the standard inner diameter of about 0.250 in.

According to the present disclosure, the inner diameter of the outlet 43 is substantially reduced relative to that of the nozzle body 40, by the presence of the throat portion 43A. More specifically, the throat portion 43A has an inner diameter of 0.094 in±0.005 in. For an inner diameter of 0.094 in, the cross-sectional area is 0.007 $in^2$. Finally, the enlarged portion 43B has an inner diameter of 0.125 in+0.000 in −0.005 in. For an inner diameter of 0.125 in, the cross-sectional area is 0.012 $in^2$. Hence, an inner diameter increase ratio between the throat portion 43A and the enlarged portion 43B being at least 1.21. Therefore, each of the nozzles 14 in accordance with the present disclosure has an inner diameter reduction ratio of at least 2.5 (i.e., the minimum nozzle body inner diameter of 0.245 in over the maximum diameter of 0.099 in of the throat portion 43A). In an embodiment, the inner diameter reduction ratio is of 2.7 using conventional nozzle body diameter of 0.250 in over the 0.094 in embodiment of the throat portion 43A.

The high inner diameter reduction ratio in the nozzles 14 results in a substantial increase in liquid velocity at the outlets 43. Moreover, the relatively small diameter of the outlet 43 may result in a needle-like massaging effect, depending on the action of the pump on the liquid in the water massage system 10.

Due to the miniaturization of the outlets 43 with respect to the diameters of the pipe network, it is possible to have a greater amount of nozzles 14 than water massage systems with standard larger diameters, for similar pump specifications. Hence, the distribution of the nozzles 14 may be over larger areas, enhancing the massaging effect produced by the water massage system 10.

In an embodiment, the water massage system 10 is without any venturi-like arrangement to add air to the flow of water. The presence of the miniaturized water nozzles 14 as described above provides a suitable massaging effect, whereby the injection of gas may be unnecessary for the water massage system 10. Moreover, the absence of gas injection in the water of the tub ultimately results in lower sound level as produced by the operating water massage system 10 compared to standard systems with air injection.

As described above, the water massage system 10 collects liquid from the tub A and exposes the liquid to a pump action. The fluid is then directed to the nozzles 14 to inject the liquid in the tub via the outlet 43 (e.g., by directing the fluid to two connector ends of the nozzle body 40). In doing so, the liquid is exposed to an inner diameter reduction between the nozzle body 40 and the outlet 43 at a ratio of at least 2.5. The liquid may then be exposed to an inner diameter increase ratio of at least 1.21.

The invention claimed is:

1. An assembly of a tub and liquid massage system, comprising:

a tub defining a bathing cavity for receiving liquid, a tub wall of the tub having a plurality of openings;

a liquid massage system comprising:

a liquid circuit for collecting liquid from the tub, the liquid having at least a pump device for exposing the liquid in the liquid circuit to a pump action; and a plurality of nozzles at ends of the liquid circuit, each said nozzle having a nozzle body with at least one connector portion in fluid communication with the liquid circuit, the nozzle body defining an inlet and an outlet adapted to be mounted to a tub wall opposite one said opening in the tub wall for feeding liquid from the liquid circuit to the outlet into the bathing cavity of the tub, at least some of the nozzles having a throat portion in the outlet and a generally constant diameter from the inlet to the throat portion, the nozzles with the throat portion having an inner diameter reduction ratio between the nozzle body and the outlet of at least 2.5.

2. The assembly according to claim 1, wherein the throat portion is part of a tubular insert received in the nozzle body.

3. The assembly according to claim 2, wherein the tubular insert has a threaded portion, the nozzle body has a tapped portion, the tubular insert being threadingly engaged to the nozzle body.

4. The assembly according to claim 2, wherein the tubular insert has a flange, the nozzle body has a flange, a peripheral portion of the tub wall about one said opening being sandwiched between the flanges.

5. The assembly according to claim 4, further comprising at least one seal between the tub wall and one of the flanges.

6. The assembly according to claim 1, further comprising an enlarged portion in the outlet downstream of the throat portion, an inner diameter increase ratio between the throat portion and the enlarged portion being at least 1.21.

7. The assembly according to claim 1, wherein the connector portion has hose barb.

8. The assembly according to claim 1, wherein the nozzle body has a tubular outlet portion and the at least one connector portion in one of a tee fitting and an elbow fitting arrangement.

9. The assembly according to claim 1, wherein the liquid circuit has flexible pipes connected to the connector portions of the nozzles.

10. The assembly according to claim 9, further comprising a rigid pipe forming a manifold to which the flexible pipes are connected, the flexible pipes being arranged to form loops connected at opposed ends to the manifold, with each said nozzle in one said loop having a pair of the connector portions.

11. The assembly according to claim 10, wherein the manifold comprises at least two manifold segments attached to one another.

12. The assembly according to claim 1, wherein the liquid massage system is without air injection.

13. The assembly according to claim 1, wherein the throat portion has an inner diameter of 0.094 in±0.005 in, and the nozzle body has an inner diameter of 0.250 in ±0.005 in.

14. A method for injecting liquid in the liquid of a tub having a plurality of nozzles mounted to a tub wall opposite openings in the tub wall, comprising:

collecting liquid from the tub and exposing the liquid to a pump action;

directing the fluid to a nozzle body of the nozzle to inject the liquid in the tub via an outlet of the nozzle body; and exposing the liquid to an inner diameter reduction between the nozzle body and the outlet at a ratio of at least 2.5.

15. The method according to claim 14, further comprising exposing the liquid to an inner diameter increase ratio of at least 1.21 after exposing the liquid to an inner diameter reduction.

16. The method according to claim 14, wherein directing the fluid to a nozzle body comprises directing the fluid to two connector ends of the nozzle body.

* * * * *